US009859606B2

(12) United States Patent
Lee et al.

(10) Patent No.: US 9,859,606 B2
(45) Date of Patent: Jan. 2, 2018

(54) WIRELESS COMMUNICATION DEVICE

(71) Applicant: Chiun Mai Communication Systems, Inc., New Taipei (TW)

(72) Inventors: Cheng-Han Lee, New Taipei (TW); Wei-Xuan Ye, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 109 days.

(21) Appl. No.: 14/591,553

(22) Filed: Jan. 7, 2015

(65) Prior Publication Data

US 2016/0164166 A1 Jun. 9, 2016

(30) Foreign Application Priority Data

Dec. 3, 2014 (CN) ..... 2014 1 0721710

(51) Int. Cl.

| | |
|---|---|
| ***H01Q 1/24*** | (2006.01) |
| ***H01Q 5/00*** | (2015.01) |
| ***H01Q 1/38*** | (2006.01) |
| ***H01Q 1/48*** | (2006.01) |
| ***H01Q 5/307*** | (2015.01) |
| ***H01Q 5/328*** | (2015.01) |
| ***H01Q 5/371*** | (2015.01) |

(52) U.S. Cl.

CPC ..... *H01Q 1/243* (2013.01); *H01Q 1/38* (2013.01); *H01Q 1/48* (2013.01); *H01Q 5/307* (2015.01); *H01Q 5/328* (2015.01); *H01Q 5/371* (2015.01)

(58) Field of Classification Search

CPC ..... H01Q 1/243; H01Q 5/30; H01Q 5/307; H01Q 5/314; H01Q 5/335; H01Q 5/357; H01Q 5/364; H01Q 1/241; H01Q 1/242

USPC ..... 343/702

See application file for complete search history.

(56) References Cited

U.S. PATENT DOCUMENTS

2004/0227678 A1* 11/2004 Sievenpiper ..... H01Q 1/243 343/702
2008/0129639 A1* 6/2008 Mitsugi ..... H01Q 1/243 343/876
2009/0256758 A1* 10/2009 Schlub ..... H01Q 1/243 343/702
2012/0176278 A1* 7/2012 Merz ..... H01Q 1/243 343/702
2012/0299785 A1* 11/2012 Bevelacqua ..... H01Q 9/42 343/702
2013/0318766 A1* 12/2013 Kiple ..... B23P 11/00 29/428

(Continued)

*Primary Examiner* — Dameon E Levi
*Assistant Examiner* — Jennifer F Hu
(74) *Attorney, Agent, or Firm* — ScienBiziP, P.C.

(57) ABSTRACT

A wireless communication device includes a metal housing and a printed circuit board. The metal housing serves as an antenna and includes a slit separating the metal housing into a radiating body and a grounding body. The slit completely separates the radiating body from the grounding body. The printed circuit board includes a system grounding point and a radio frequency circuit. The system grounding point is electronically coupled to the grounding body. The radiating body has a first grounding point, a second grounding point and a feeding point located between the first and second points. The feeding point is electronically coupled to the radio frequency circuit. The first and second grounding points are electronically coupled to the system grounding point.

14 Claims, 4 Drawing Sheets

(56) References Cited

U.S. PATENT DOCUMENTS

2016/0064812 A1* 3/2016 Han ..... H01Q 1/50
343/702
2016/0079653 A1* 3/2016 Kanj ..... H01Q 1/243
343/702

* cited by examiner

WIRELESS COMMUNICATION DEVICE

FIELD

The subject matter herein generally relates to wireless communication devices, and particularly to a wireless communication device having a metal housing.

BACKGROUND

Metal housings are widely used for electronic devices such as mobile phones or personal digital assistants (PDAs). Antennas are also widely used in electronic devices. However, signals of the antenna located in the metal housing are often shielded by the metal housing.

BRIEF DESCRIPTION OF THE DRAWINGS

Implementations of the present technology will now be described, by way of example only, with reference to the attached figures.

DETAILED DESCRIPTION

Figure 1:
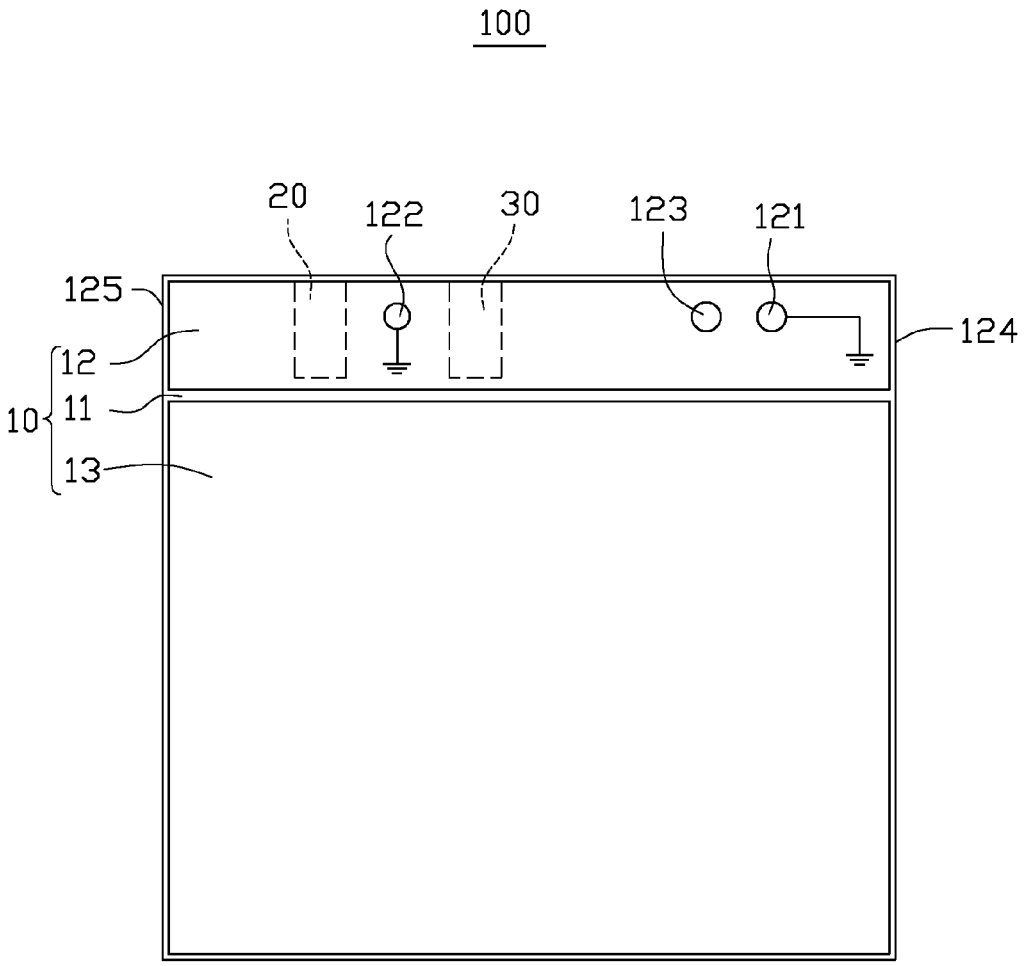
FIG. 1 is a diagrammatic view of one embodiment of a wireless communication device having a metal housing.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" when utilized, means "including, but not necessarily limited to"; it specifically indicates open-ended inclusion or membership in the so-described combination, group, series and the like.

FIG. 1 illustrates a diagrammatic view of one embodiment of a wireless communication device 100, such as a cellular phone or a tablet computer. The wireless communication device 100 can include a metal housing 10 serving as an antenna structure to send/receive wireless signals. The metal housing 10 defines a slit 11 that separates the metal housing 10 into a radiating body 12 and a grounding body

13. In at least one embodiment, the slit 11 completely separates the radiating body 12 from the grounding body 13. The slit 11 can be filled with non-conductive materials to physically couple the radiating body 12 and the grounding body 13 together.

The radiating body 12 includes a first grounding point 121, a second grounding point 122 and a feeding point 123 located between the first and second grounding points 121, 122. The radiating body 12 further includes a first edge 124 and an opposite second edge 125 parallel to the first edge 124. In at least one embodiment, lengths of the first and second edges 124 and 125 are both about 10 mm; a distance between the first and second edges 124 and 125 is about 75 mm; a distance between the first grounding point 121 and the first edge 124 is about 14 mm; a distance between the feeding point 123 and the first edge 124 is about 18 mm; a distance between the second grounding point 122 and the second edge 125 is about 21 mm.

The wireless communication device 100 is also provided with a first electronic component 20 and a second electronic component 30 both of which are located inside the wireless communication device 100 and adjacent to the radiating body 12, and are positioned at two opposite sides of the second grounding point 122 respectively. In at least one embodiment, the first electronic component 20 is an audio jack, the second electronic component 30 is an USB connector.

Figure 2:
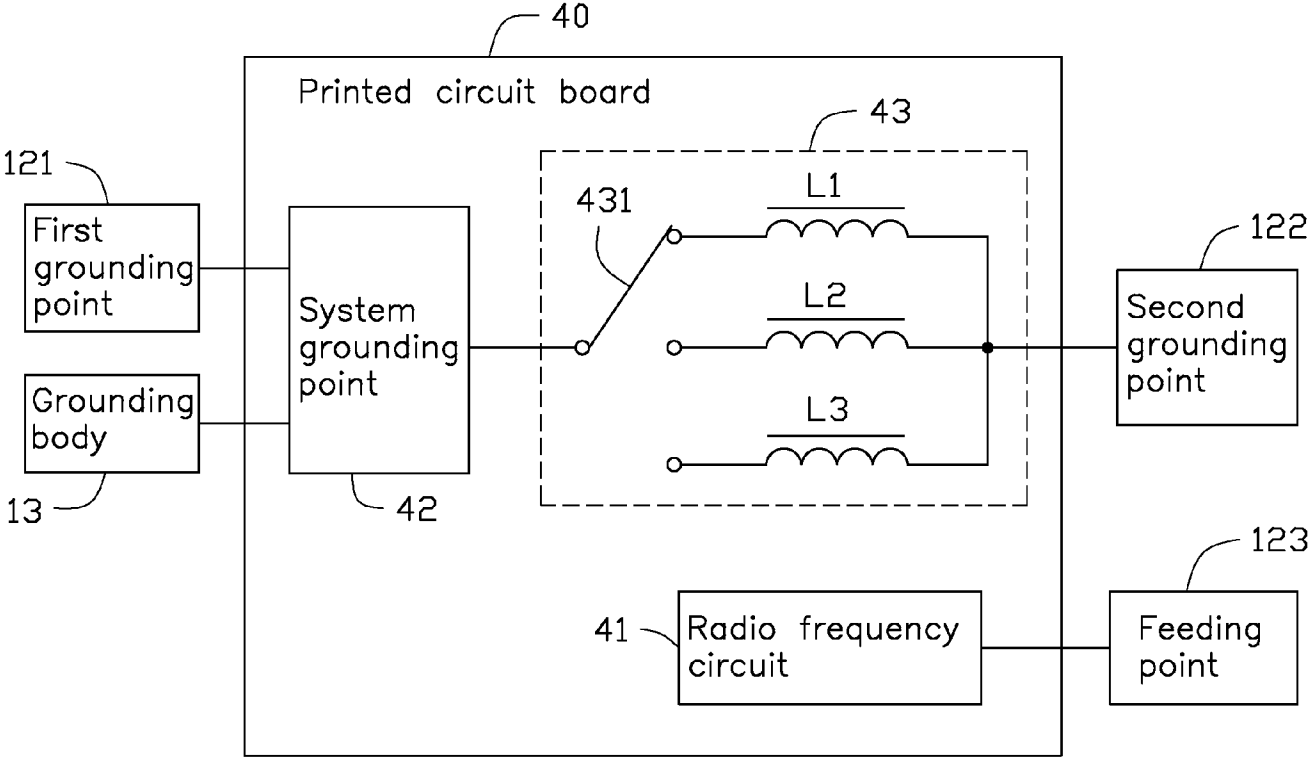
FIG. 2 is a block diagram of the wireless communication device as shown in FIG. 1.

FIG. 2 illustrates a block diagram of the wireless communication device 100 as shown in FIG. 1. The wireless communication device 100 is also provided with a printed circuit board 40. The printed circuit board 40 includes a radio frequency circuit 41 and a system grounding point 42. The radio frequency circuit 41 is electronically coupled to the feeding point 123 of the radiating body 12, and is configured to feed current signals to the feeding point 123. The system grounding point 42 is electronically coupled to both the first and second grounding points 121 and 122, the system grounding point 42 is also electronically coupled to the grounding body 13, such as by an elastic metal member or a metal screw. The grounding body 13 can serve as a system ground plane of the wireless communication device 100, such that the first and second grounding points 121 and 122 can be grounded via the system grounding point 42. When current signals are fed to the feeding point 123, the current signals can flow through the radiating body 12 (see FIG. 1) to form different current paths. In particular, a first current path can be formed from the feeding point 123 to the grounding body 13 via the first grounding point 121 (see FIG. 1) and the system grounding point 42 to generate at least one high frequency resonate mode; a second current path can be formed from the feeding point 123 to the grounding body 13 via the second grounding point 122 (see FIG. 1) and the system grounding point 42 to generate a low frequency resonate mode.

In the exemplary embodiment, a regulating circuit 43 is also included that is electronically coupled between the system grounding point 42 and the second grounding point 122. The regulating circuit 43 is configured to regulate a central frequency of an operating frequency band of the low frequency resonate mode. The regulating circuit 43 includes a switch 431 and three inductors L1, L2 and L3. Inductances of the inductors L1, L2 and L3 are different. The switch 421 is configured to selectively couple one of the inductors L1, L2 and L3 to the second grounding point 122. When the inductor L1 having an inductance of about 12 nH is coupled between the system grounding point 42 and the second grounding point 122, the radiating body 12 can resonate at about 700 MHz; when the inductor L2 having an inductance of about 8.2 nH is coupled between the system grounding point 42 and the second grounding point 122, the radiating body 12 can resonate at about 850 MHz; when the inductor L3 having an inductance of about 4.7 nH is coupled between the system grounding point 42 and the second grounding point 122, the radiating body 12 can resonate at about 900 MHz.

Figure 3:
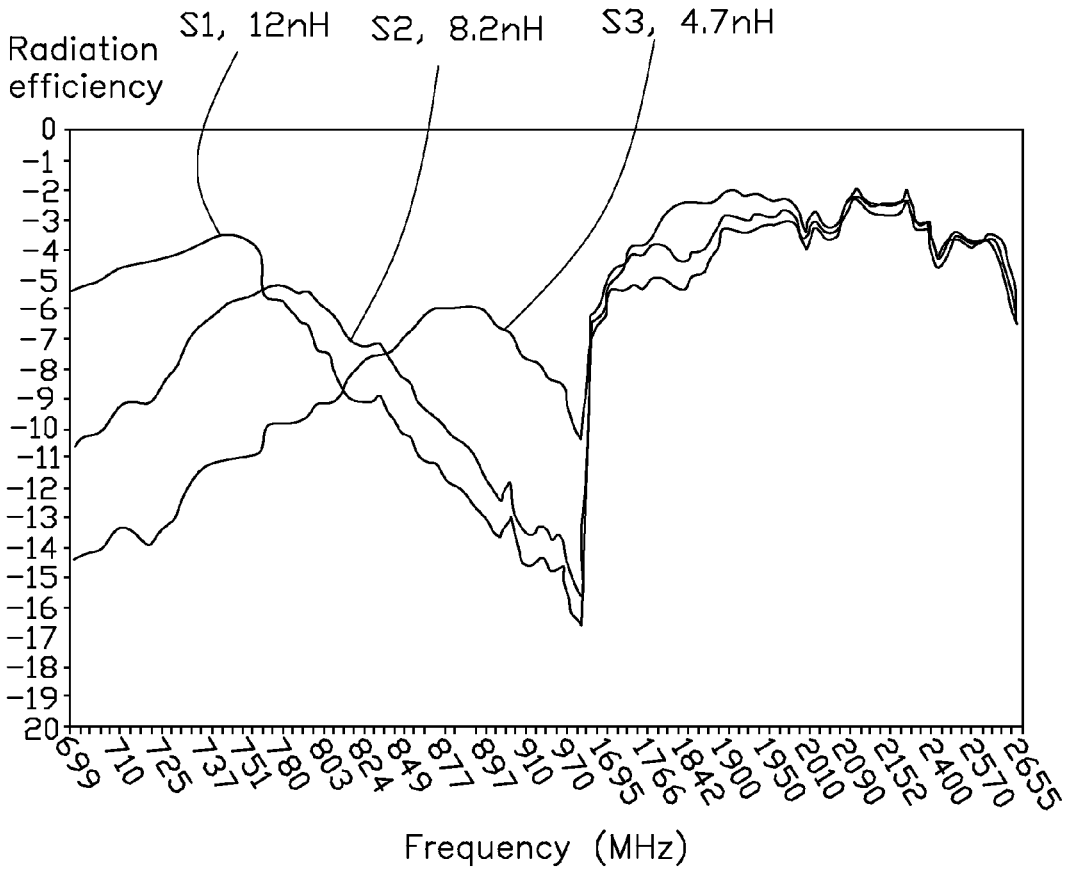
FIG. 3 illustrates a diagram showing radiation efficiency measurements of the wireless communication device as shown in FIGS. 1-2.

FIG. 3 illustrates a diagram showing radiation efficiency measurements of the antenna structure as shown in FIGS. 1-2. Curve S1 represents the radiation efficiency of the wireless communication device 100 when the inductor L1 is electronically coupled between the system grounding point 42 and the second grounding point 122. Curve S2 represents the radiation efficiency of the antenna structure when the inductor L2 is electronically coupled between the system grounding point 42 and the second grounding point 122. Curve S3 represents the radiation efficiency of the antenna structure when the inductor L3 is electronically coupled between the system grounding point 42 and the second grounding point 122. It can be derived from FIG. 3 that the antenna structure can operate at low frequency band from about 700 MHz to about 900 MHz, and a high frequency band from about 1710 MHz to about 2690 MHz, with exceptional communication quality.

Figure 4:
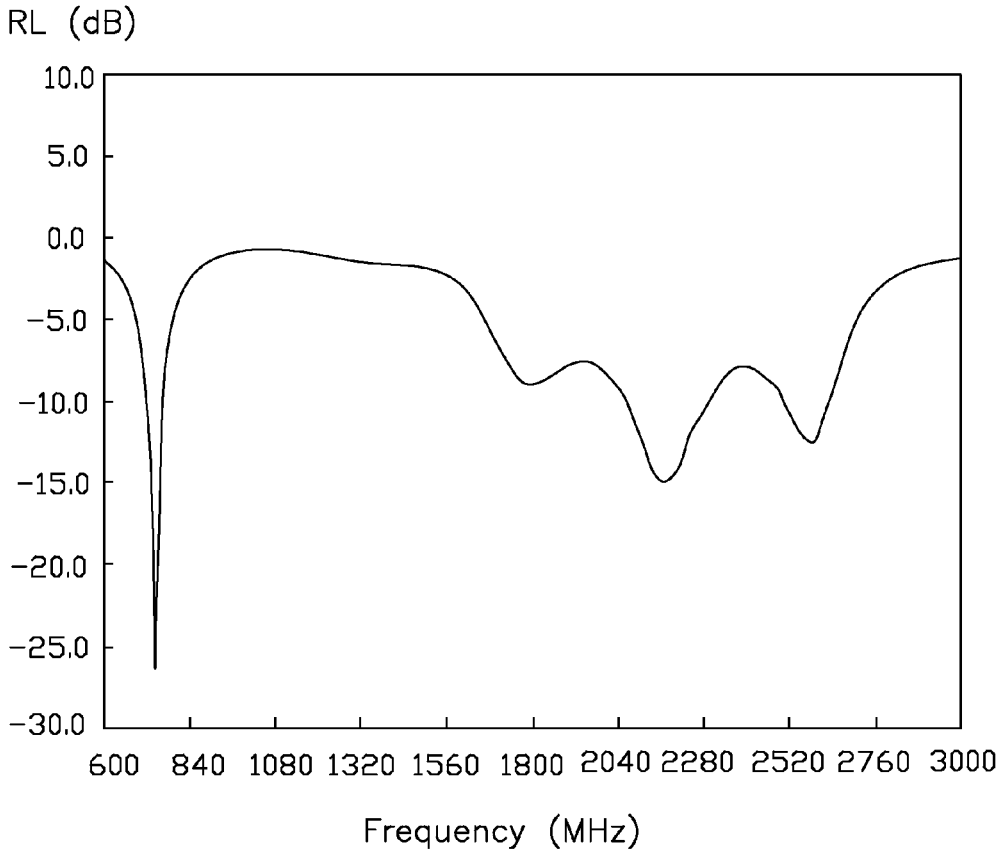
FIG. 4 illustrates a return loss ("RL") measurement of the wireless communication device as shown in FIGS. 1-2.

FIG. 4 illustrates a return loss ("RL") measurement of the antenna structure when the inductor L1 is electronically coupled between the system grounding point 42 and the second grounding point 122. It can be derived from FIG. 4 that the RL of the antenna structure is lower than −5 dB when the antenna structure operates at about 700 MHz and the high frequency band from about 1710 MHz to about 2690 MHz.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A wireless communication device comprising:

a printed circuit board comprising a system grounding point, a radio frequency circuit and a regulating circuit, wherein the regulating circuit comprises a switch and a plurality of inductors, and inductances of the plurality of inductors are different;

a metal housing serving as an antenna and comprising a slit separating the metal housing into a radiating body and a grounding body, wherein the radiating body comprises a first grounding point, a second grounding point and a feeding point located between the first and second grounding points and electronically coupled to the radio frequency circuit;

a first electronic component and a second electronic component positioned adjacent to the radiating body;

wherein the grounding body is co-planar with the radiating body and serves as a system ground plane of the wireless communication device, and the first and second grounding points are electronically coupled to the grounding body through the system grounding point of the printed circuit board; and wherein the regulating circuit is configured to regulate a central frequency of an operating frequency band, and the switch of the regulating circuit is configured to selectively and electronically couple one of the plurality of inductors between the system grounding point of the printed circuit board and the second grounding point of the radiating body;

wherein the first and second electronic components are electronically coupled to the printed circuit board, and are positioned at two opposite sides of the second grounding point respectively, the first electronic component is an audio jack, and the second electronic component is an USB connector.

2. The wireless communication device of claim 1, wherein the radiating body, the grounding body and the printed circuit board are configured to cooperatively form a first current path from the feeding point to the grounding body via the first grounding point and the system grounding point, and form a second current path from the feeding point to the grounding body via the second grounding point and the system grounding point; and wherein the first current path generates at least one high frequency resonate mode, and the second current path generates a low frequency resonate mode.

3. The wireless communication device of claim 2, wherein the regulating circuit is configured to regulate an operating frequency band of the low frequency resonate mode.

4. The wireless communication device of claim 1, wherein the slit is filled with non-conductive material to couple the radiating body and the grounding body together and completely separates the radiating body from the grounding body.

5. The wireless communication device of claim 1, wherein the radiating body comprises a first edge and a second edge parallel to the first edge; a length of the first and second edges is shorter than a first distance between the first and second edges; a second distance between the first grounding point and the first edge is shorter than a third distance between the feeding point and the first edge; and a fourth distance between the second grounding point and the second edge is longer than the second distance and the third distance.

6. The wireless communication device of claim 1, wherein the system grounding point is electronically coupled to the grounding body by an elastic metal member or a metal screw.

7. The wireless communication device of claim 1, wherein the plurality of inductors include a first conductor having a first inductance and a second conductor having a second inductance; the radiating body resonates at a first frequency when the switch electronically couples the first conductor between the system grounding point and the second grounding point; and the radiating body resonates at a second frequency when the switch electronically couples the second conductor between the system grounding point and the second grounding point.

8. The wireless communication device of claim 7, wherein the first frequency is about 700 MHz, and the first frequency is about 850 MHz or about 900 MHz.

9. A wireless communication device comprising:

a printed circuit board comprising a system grounding point, a radio frequency circuit and a regulating circuit, wherein the regulating circuit comprises a switch, a first inductor having a first inductance and a second inductor having a second inductance;

a metal housing serving as an antenna and comprising a slit separating the metal housing into a radiating body and a grounding body, wherein the radiating body comprises a first grounding point, a second grounding point and a feeding point located between the first and second points and electronically coupled to the radio frequency circuit;

a first electronic component and a second electronic component positioned adjacent to the radiating body;

wherein the grounding body is co-planar with the radiating body, and the first and second grounding points of the radiating body are electronically coupled to the grounding body through the system grounding point of the printed circuit board;

wherein the switch of the regulating circuit is configured to selectively and electronically couple one of the first inductor and the second inductor between the system grounding point of the printed circuit board and the second grounding point of the radiating body;

wherein the radiating body resonates at a first low frequency when the switch electronically couples the first inductor between the system grounding point and the second grounding point; and the radiating body resonates at a second low frequency when the switch electronically couples the second inductor between the system grounding point and the second grounding point; and wherein the antenna is configured to operate at a low frequency band from about the first low frequency to about the second low frequency and at a high frequency band from about a first high frequency to about a second high frequency;

wherein the first and second electronic components are electronically coupled to the printed circuit board, and are positioned at two opposite sides of the second grounding point respectively, the first electronic component is an audio jack, and the second electronic component is an USB connector.

10. The wireless communication device of claim 9, wherein the radiating body, the grounding body and the printed circuit board are configured to cooperatively form a first current path from the feeding point to the grounding body via the first grounding point and the system grounding point, and forms a second current path from the feeding point to the grounding body via the second grounding point and the system grounding point; and wherein the first current path generates at least one high frequency resonate mode, and the second current path generates a low frequency resonate mode.

11. The wireless communication device of claim 9, wherein the regulating circuit is configured to regulate an operating frequency band of the low frequency resonate mode.

12. The wireless communication device of claim 9, wherein the slit is filled with non-conductive material to couple the radiating body and the grounding body together and completely separates the radiating body from the grounding body.

13. The wireless communication device of claim 9, wherein the radiating body comprises a first edge and a second edge parallel to the first edge; a length of the first and second edges is shorter than a first distance between the first and second edges; a second distance between the first grounding point and the first edge is shorter than a third distance between the feeding point and the first edge; and a fourth distance between the second grounding point and the second edge is longer than the second distance and the fourth distance.

14. The wireless communication device of claim 9, wherein the system grounding point is electronically coupled to the grounding body by an elastic metal member or a metal screw.

* * * * *